US011380282B2

(12) United States Patent
Wang

(10) Patent No.: US 11,380,282 B2
(45) Date of Patent: Jul. 5, 2022

(54) GAMMA VOLTAGE GENERATING CIRCUIT, DRIVER CIRCUIT AND DISPLAY DEVICE

(71) Applicant: BOE TECHNOLOGY GROUP CO., LTD., Beijing (CN)

(72) Inventor: Wenbo Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 38 days.

(21) Appl. No.: 17/044,206

(22) PCT Filed: Dec. 25, 2019

(86) PCT No.: PCT/CN2019/128453

§ 371 (c)(1),
(2) Date: Sep. 30, 2020

(87) PCT Pub. No.: WO2020/173207

PCT Pub. Date: Sep. 3, 2020

(65) Prior Publication Data

US 2021/0134239 A1 May 6, 2021

(30) Foreign Application Priority Data

Feb. 25, 2019 (CN) ..... 201910138342.2

(51) Int. Cl.
*G09G 3/36* (2006.01)

(52) U.S. Cl.
CPC ..... *G09G 3/3696* (2013.01); *G09G 3/3688* (2013.01); *G09G 2320/0233* (2013.01); *G09G 2320/0673* (2013.01)

(58) Field of Classification Search
CPC ... G09G 2320/0673; G09G 2320/0626; G09G 2320/0233; G09G 2320/0247;
(Continued)

(56) References Cited

U.S. PATENT DOCUMENTS

2002/0186231 A1* 12/2002 Kudo ..... G09G 3/20 345/690
2003/0151578 A1* 8/2003 Morita ..... G09G 3/3688 345/89

(Continued)

FOREIGN PATENT DOCUMENTS

CN 101059946 A 10/2007
CN 101650923 A 2/2010

(Continued)

OTHER PUBLICATIONS

Office Action dated Mar. 19, 2020 in counterpart CN Patent Application No. 201910138342.2, 25 pages.

(Continued)

*Primary Examiner* — Dong Hui Liang
(74) *Attorney, Agent, or Firm* — Procopio, Cory, Hargreaves & Savitch LLP

(57) ABSTRACT

A gamma voltage generating circuit includes N gamma voltage generating sub-circuits. Each gamma voltage generating sub-circuit includes a resistive voltage divider circuit and a plurality of gamma reference voltage output terminals. Each resistive voltage divider circuit includes a plurality of resistors connected in series, and any two resistive voltage divider circuits have a same resistance ratio of the plurality of resistors. The N gamma voltage generating sub-circuits include a first gamma voltage generating sub-circuit. The first gamma voltage generating sub-circuit further includes a gamma voltage generation circuit. Output terminals of the gamma voltage generation circuit are electrically connected to a highest gamma reference voltage output terminal and a lowest gamma reference voltage output terminal, respectively. Highest gamma reference voltage output terminals of the gamma voltage generating sub-circuits are connected,
(Continued)

and lowest gamma reference voltage output terminals of the gamma voltage generating sub-circuits are connected.

15 Claims, 6 Drawing Sheets

(58) Field of Classification Search
CPC ..... G09G 3/3696; G09G 3/3688; G09G 3/20; G09G 3/36; G09G 3/3648; G09G 3/3233; G09G 3/3208; G09G 3/3275; G09G 3/3685; G09G 3/30; G09G 3/3406; G09G 3/2092; G09G 2330/021; G09G 2330/028; G09G 2310/0291; G09G 2310/0297
See application file for complete search history.

(56) References Cited

U.S. PATENT DOCUMENTS

| | | | | |
|---|---|---|---|---|
| 2007/0063948 | A1* | 3/2007 | Nishimura | G09G 3/3696 345/89 |
| 2007/0139313 | A1* | 6/2007 | Choi | G09G 3/2011 345/76 |
| 2007/0182683 | A1* | 8/2007 | Chin | G09G 3/3688 345/88 |
| 2007/0247409 | A1 | 10/2007 | Nishimura et al. | |
| 2010/0225678 | A1 | 9/2010 | Kim et al. | |
| 2014/0022287 | A1 | 1/2014 | Ahn | |
| 2015/0109348 | A1* | 4/2015 | Hikichi | G09G 3/3688 345/690 |
| 2015/0130852 | A1* | 5/2015 | Wang | G09G 3/20 345/690 |
| 2020/0051478 | A1 | 2/2020 | Wang | |
| 2020/0312208 | A1* | 10/2020 | Li | G09G 3/3685 |

FOREIGN PATENT DOCUMENTS

| | | | |
|---|---|---|---|
| CN | 104575415 | A | 4/2015 |
| CN | 106920520 | A | 7/2017 |
| CN | 108877660 | A | 11/2018 |
| CN | 108986731 | A | 12/2018 |
| CN | 109658896 | A | 4/2019 |
| KR | 20130130546 | A | 12/2013 |
| WO | 2020029681 | A1 | 2/2020 |

OTHER PUBLICATIONS

Office Action dated Oct. 19, 2020 in counterpart CN Patent Application No. 201910138342.2, 22 pages.
Notification to Grant Patent Right for Invention dated Jan. 29, 2021 in counterpart CN Patent Application No. 201910138342.2, 9 pages.

* cited by examiner

GAMMA VOLTAGE GENERATING CIRCUIT, DRIVER CIRCUIT AND DISPLAY DEVICE

CROSS-REFERENCE TO RELATED APPLICATIONS

This application is a national phase entry under 35 USC 371 of International Patent Application No. PCT/CN2019/128453 filed on Dec. 25, 2019, which claims priority to Chinese Patent Application No. 201910138342.2, filed on Feb. 25, 2019, which are incorporated herein by reference in their entirety.

TECHNICAL FIELD

The present disclosure relates to the field of display technologies, and in particular, to a gamma voltage generating circuit, a driver circuit and a display device.

BACKGROUND

With the development of large-sized display panel technologies, more and more large-sized display panels use two or more data driver integrated circuits (ICs) (i.e., chips), that is, multiple data driver ICs are used to control lighting of all pixels.

SUMMARY

In an aspect, a gamma voltage generating circuit is provided. The gamma voltage generating circuit includes N gamma voltage generating sub-circuits, and N is greater than or equal to 2. Each gamma voltage generating sub-circuit includes a resistive voltage divider circuit and a plurality of gamma reference voltage output terminals. Each resistive voltage divider circuit includes a plurality of resistors connected in series, and one of the plurality of resistors is connected between every two adjacent gamma reference voltage output terminals, and any two of N resistive voltage divider circuits have a same resistance ratio of the plurality of resistors connected in series. The N gamma voltage generating sub-circuits include a first gamma voltage generation sub-circuit. The first gamma voltage generating sub-circuit further includes a gamma voltage generation circuit, and output terminals of the gamma voltage generation circuit is electrically connected to a highest gamma reference voltage output terminal and a lowest gamma reference voltage output terminal in the plurality of gamma reference voltage output terminals of the first gamma voltage generating sub-circuit, respectively. Highest gamma reference voltage output terminals of the N gamma voltage generating sub-circuits are connected, and lowest gamma reference voltage output terminals of the N gamma voltage generating sub-circuits are connected.

In some embodiments, the first gamma voltage generating sub-circuit further includes first control switches provided between an output terminal of the gamma voltage generation circuit and the highest gamma reference voltage output terminal, and between another output terminal of the gamma voltage generation circuit and the gamma reference voltage output terminal, respectively. The first control switches are configured to connect or disconnect the output terminal of the gamma voltage generation circuit and the highest gamma reference voltage output terminal, and to connect or disconnect the another output terminal of the gamma voltage generation circuit and the lowest gamma reference voltage output terminal.

In some embodiments, the N gamma voltage generating sub-circuits further include at least one second gamma voltage generating sub-circuit. Each second gamma voltage generating sub-circuit includes a gamma voltage generation circuit. In each second gamma voltage generating sub-circuit, output terminals of the gamma voltage generation circuit are electrically connected to a highest gamma reference voltage output terminal and a lowest gamma reference voltage output terminal in a plurality of gamma reference voltage output terminals of the second gamma voltage generating sub-circuit, respectively.

In some embodiments, the second gamma voltage generating sub-circuit further includes second control switches provided between an output terminal of the gamma voltage generation circuit and the highest gamma reference voltage output terminal, and between another output terminal of the gamma voltage generation circuit and the lowest gamma reference voltage output terminal of the second gamma voltage generating sub-circuit, respectively. The second control switches are configured to connect or disconnect the output terminal of the gamma voltage generation circuit and the highest gamma reference voltage output terminal of the second gamma voltage generating sub-circuit, and to connect or disconnect the another output terminal of the gamma voltage generation circuit and the lowest gamma reference voltage output terminal of the second gamma voltage generating sub-circuit.

In some embodiments, in the N gamma voltage generating sub-circuits, gamma reference voltage output terminals corresponding to a same gray scale in gamma reference voltage output terminals other than the highest gamma reference voltage output terminals and the lowest gamma reference voltage output terminals are connected.

In some embodiments, each of the plurality of resistors is a variable resistor.

In another aspect, a gamma voltage generating circuit is provided. The gamma voltage generating circuit includes N gamma voltage generating sub-circuits, and N is greater than or equal to 2. Each gamma voltage generating sub-circuit includes a gamma voltage generation circuit, a resistive voltage divider circuit and a plurality of gamma reference voltage output terminals. Output terminals of the gamma voltage generation circuit are electrically connected to a highest gamma reference voltage output terminal and a lowest gamma reference voltage output terminal in the plurality of gamma reference voltage output terminals, respectively. Each resistive voltage divider circuit includes a plurality of resistors connected in series, and any two of the N resistive voltage divider circuits have a same resistance ratio of the plurality of resistors connected in series. In each gamma voltage generating sub-circuit, one of the plurality of resistors is connected between every two adjacent gamma reference voltage output terminals. The N gamma voltage generating sub-circuits include a first gamma voltage generating sub-circuit and at least one second gamma voltage generating sub-circuit. Each gamma voltage generating sub-circuit further includes a voltage modification module. The voltage modification module is configured to modify voltages at an output terminals of a gamma voltage generation circuit of the second gamma voltage generating sub-circuit, according to a voltage difference between gamma reference voltage output terminals corresponding to a same gray scale of the first gamma voltage generating sub-circuit and the second gamma voltage generating sub-circuit, so as to make voltages at gamma reference voltage output terminals of the N gamma voltage generating sub-circuits at the same gray scale are the same.

In some embodiments, the each second gamma voltage generating sub-circuit further includes a first comparator and a second comparator. A non-inverting input terminal of the first comparator is electrically connected to a highest gamma reference voltage output terminal of the first gamma voltage generating sub-circuit, and an inverting input terminal of the first comparator is electrically connected to a highest gamma reference voltage output terminal of the second gamma voltage generating sub-circuit. A non-inverting input terminal of the second comparator is electrically connected to a lowest gamma reference voltage output terminal of the first gamma voltage generating sub-circuit, and an inverting input terminal of the first comparator is electrically connected to a lowest gamma reference voltage output terminal of the second gamma voltage generating sub-circuit.

In some embodiments, each second gamma voltage generating sub-circuit further includes a first voltage collector and a second collector. The first voltage collector is electrically connected between the first comparator and the highest gamma reference voltage output terminal of the second gamma voltage generating sub-circuit. The second voltage collector is electrically connected between the second comparator and the lowest gamma reference voltage output terminal of the second gamma voltage generating sub-circuit.

In some embodiments, the voltage modification module further includes a first adder and a second adder. The first adder is electrically connected to an output terminal of the first comparator and an input terminal connected to the highest gamma reference voltage output terminal of the second gamma voltage generating sub-circuit. The second adder is electrically connected to an output terminal of the second comparator and an input terminal connected to the lowest gamma reference voltage output terminal of the second gamma voltage generating sub-circuit.

In some embodiments, the voltage modification module includes operational amplifiers. A non-inverting input terminal of each operational amplifier is electrically connected to an output terminal of a corresponding gamma voltage generation circuit of the second gamma voltage generating sub-circuit, and an output terminal of the operational amplifier is electrically connected to a corresponding gamma reference voltage output terminal of the second gamma voltage generating sub-circuit, and an inverting terminal of the operational amplifier is configured to receive a voltage difference between gamma reference voltage output terminals corresponding to a same gray scale of the first gamma voltage generating sub-circuit and the second gamma voltage generating sub-circuit where the operational amplifier is located.

In some embodiments, in the N gamma voltage generating sub-circuits, gamma reference voltage output terminals corresponding to a same gray scale are connected.

In yet another aspect, a driver circuit is provided. The driver circuit includes any one of the gamma voltage generating circuit as above and a plurality of data driver circuits. Each of the plurality of data driver circuits is electrically connected to one gamma voltage generating sub-circuit of the gamma voltage generating circuit. The gamma voltage generating sub-circuit is configured to provide gamma reference voltages to the data driver circuit.

In yet another aspect, a display device is provided. The display device includes the driver circuit as above.

BRIEF DESCRIPTION OF THE DRAWINGS

In order to describe technical solutions in the present disclosure more clearly, accompanying drawings to be used in some embodiments of the present disclosure will be introduced briefly. Obviously, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on actual dimensions of products, actual processes of methods and actual timings of signals to which the embodiments of the present disclosure relate.

DETAILED DESCRIPTION

Technical solutions in some embodiments of the present disclosure will be described clearly and completely with reference to accompanying drawings. Obviously, the described embodiments are merely some but not all of the embodiments of the present disclosure. All other embodiments obtained on a basis of embodiments of the present disclosure by a person of ordinary skill in the art shall be included in the protection scope of the present disclosure.

Unless the context requires otherwise, throughout the description and claims, terms "comprise" and other forms thereof such as the third-person singular form "comprises" and the present participle form "comprising" are construed as an open and inclusive meaning, i.e., "including, but not limited to". In the description, terms such as "one embodiment", "some embodiments", "exemplary embodiments", "example", "some examples", or "specific example" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Words such as "first" and "second" are used for descriptive purposes only, and are not to be construed as indicating or implying the relative importance or implicitly indicating the number of indicated technical features below. Thus, features defined by "first" and "second" may explicitly or implicitly include one or more of the features. In the description of the embodiments of the present disclosure, both the term "a plurality of" and "the plurality of" mean two or more unless otherwise specified.

Figure 1:
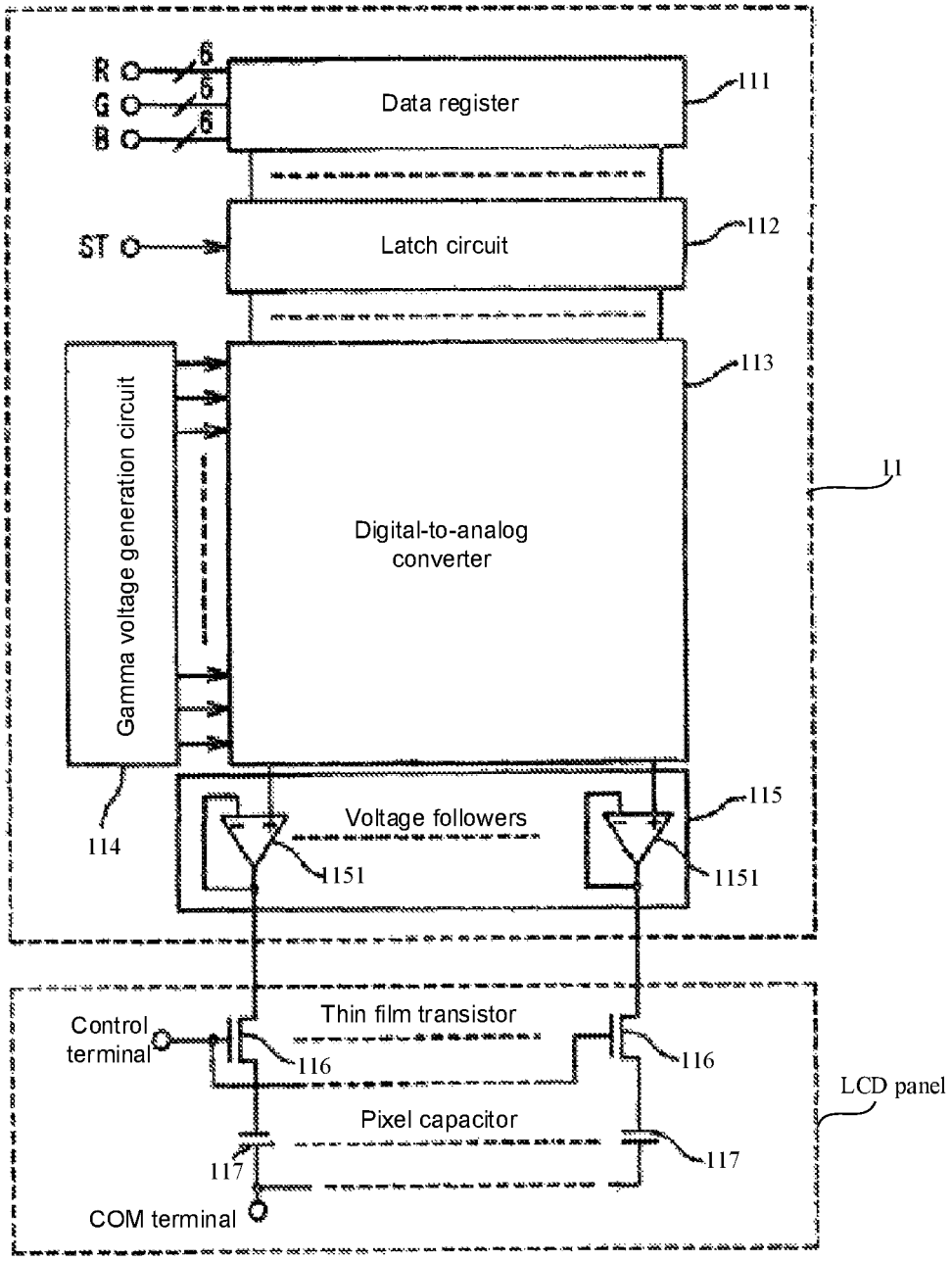
FIG. 1 is a structural diagram of a data driver IC and a liquid crystal display (LCD) panel in a display panel, in accordance with some embodiments.

As shown in FIG. 1, a display panel includes a data driver integrated circuit (IC) 11 and a liquid crystal display (LCD) panel. The data driver IC 11 generally includes a data register 111, a latch circuit 112, a digital-to-analog converter 113, a gamma voltage generating circuit 114 and an output amplifier 115. The data register 111 is configured to receive 6-bit digital display data R, G and B. The latch circuit 112 is configured to latch the digital display data in synchronization with a strobe signal (ST). The digital-to-analog converter 113 is composed of n-stage digital/analog conversion circuits arranged in parallel. The gamma voltage generating circuit 114 is configured to generate gray scale voltages, and the gray scale voltages have gray scales of gamma characteristics based on the characteristics of the display panel. The output amplifier 115 is configured to buffer voltages output from the digital-to-analog converter 113, and the output amplifier 115 has a plurality of voltage followers 1151. Herein, the gray scale voltage generated by the gamma voltage generating circuit 114 is used as a reference voltage of a data signal supplied through a data line.

The LCD panel includes thin film transistors 116 and pixel capacitors 117. The thin film transistor 116 is disposed at a region where a data line and a scanning line cross. The pixel capacitor 117 is electrically connected to the thin film transistor 116. For example, a gate of the thin film transistor 116 is electrically connected to the scanning line, and a source of the thin film transistor 116 is electrically connected to the data line. One terminal of the pixel capacitor 117 is connected to a drain of the thin film transistor 116, and another terminal of the pixel capacitor 117 is connected to a common voltage (COM) node.

Figure 2:
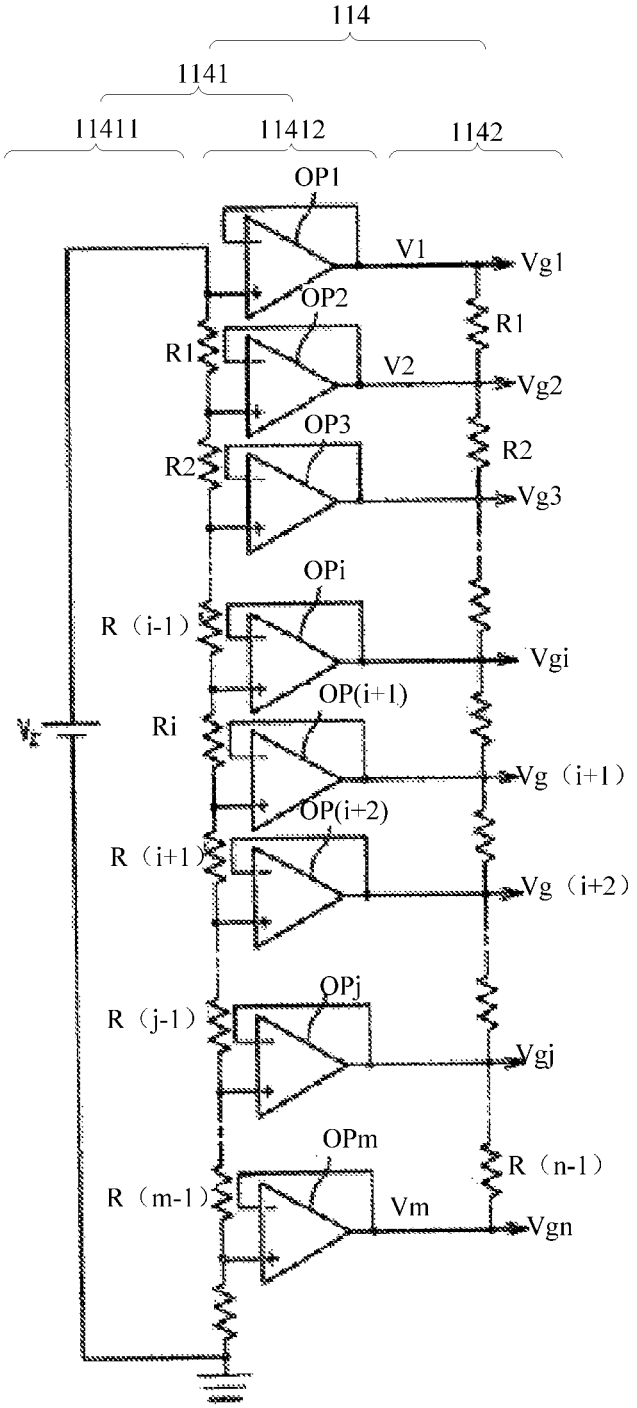
FIG. 2 is a structural diagram of a gamma voltage generating circuit, in accordance with some embodiments.

In some embodiments, as shown in FIG. 2, the gamma voltage generating circuit 114 includes a gamma voltage generation circuit 1141 and a resistive voltage divider circuit 1142 electrically connected to the gamma voltage generation circuit 1141. The gamma voltage generation circuit 1141 includes a constant voltage generation circuit 11411 configured to output a reference voltage, and a buffer amplifier 11412 including a plurality of operational amplifiers OP1 to OPm that are used as voltage followers. The resistive voltage divider circuit 1142 includes a plurality of resistors such as R1, R2, . . . , R(n−1) that are connected in series, and is configured to divide the voltage output from the buffer amplifier 11412 into a plurality of gray scale voltages Vg1 to Vgn. The plurality of gray scale voltages Vg1 to Vgn are used as reference voltages of data signals supplied through data lines.

As shown in FIG. 2, there are resistors R1 to R(m−1) connected in series between the constant voltage generation circuit 11411 and the operational amplifiers OP1 to OPm. The resistors R1 to R(m−1) are connected to non-inverting input terminals of the operational amplifiers OP1 to OPm. The operational amplifiers OP1 to OPm output voltages V1 to Vm according to tap voltages of the resistors R1 to R(m−1), where m is less than or equal to n. FIG. 2 shows a case where m is equal to n.

For a display panel driven by a plurality of data driver ICs together, each data driver IC includes a respective gamma voltage generating circuit 114. Due to offset voltages caused by the operational amplifiers OP1 to OPm in each gamma voltage generating circuit 114, gamma voltage generating circuits 114 in the plurality of data driver ICs may generate different gray scale voltages Vg1 to different gray scale voltages Vgn. That is, gray scale characteristics of the plurality of data driver ICs are different. In this case, if the plurality of data driver ICs are systematically arranged and the display panel is driven in response to data signals based on the gray scale voltages Vg1 to Vgn, there are differences among gray scale voltages of the data driver ICs corresponding to a same gray scale, which are generally within 15 mV and may result in luminance unevenness of the display panel during display.

Figure 3:
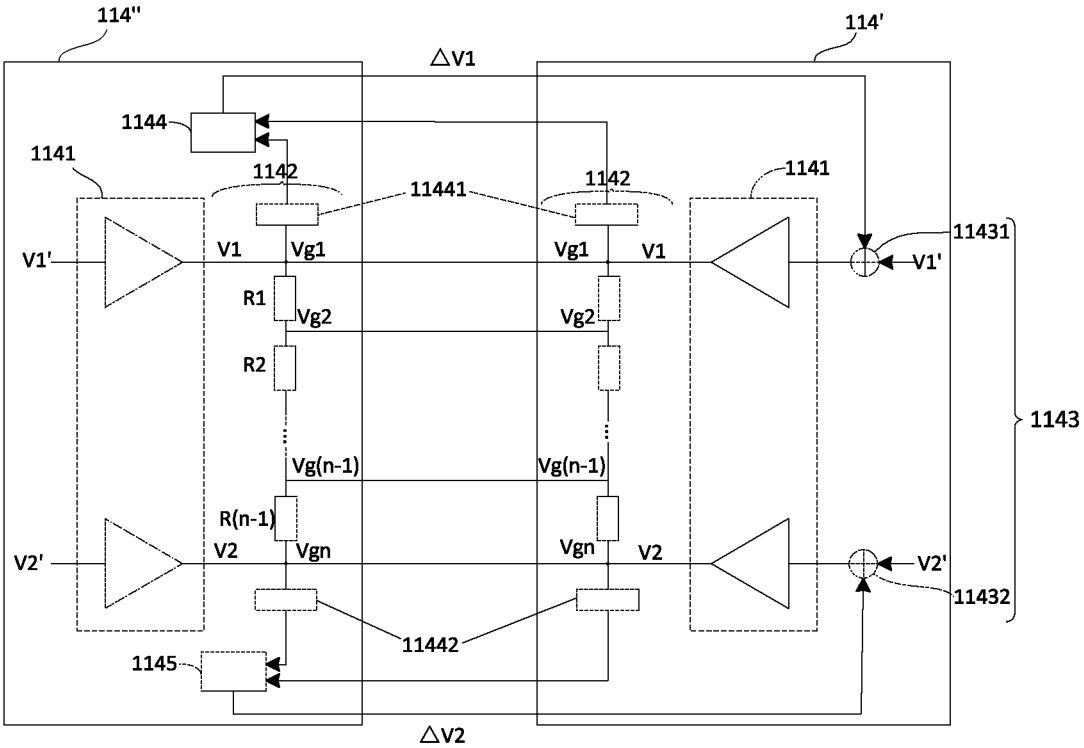
FIG. 3 is a structural diagram of a gamma voltage generating circuit, in accordance with some embodiments.

For this reason, some embodiments of the present disclosure provide a gamma voltage generating circuit. Referring to FIG. 3, the gamma voltage generating circuit includes N gamma voltage generating sub-circuits 114, and N is greater than or equal to 2.

One of the N gamma voltage generating sub-circuits serves as a first gamma voltage generating sub-circuit (indicated by reference numeral 114'), and other gamma voltage generating sub-circuit(s) except the first gamma voltage generating sub-circuit serve as second gamma voltage generating sub-circuit(s) (indicated by reference numeral 114"). In a case where it is not distinguished whether the gamma voltage generating sub-circuit is the first gamma voltage generating sub-circuit or the second gamma voltage generating sub-circuit, the gamma voltage generating sub-circuit is indicated by reference numeral 114.

Each of the N gamma voltage generating sub-circuits 114 includes a gamma voltage generation circuit 1141, a resistive voltage divider circuit 1142, and a plurality of gamma reference voltage output terminals (Vg1, Vg2, . . . , Vgn shown in FIG. 3). Output terminals of the gamma voltage generation circuit 1141 (V1, . . . , Vm shown in FIG. 3) are electrically connected to at least a highest gamma reference voltage output terminal Vg1 and a lowest gamma reference voltage output terminal Vgn in the plurality of gamma reference voltage output terminals (Vg1, Vg2, . . . , Vgn shown in FIG. 3).

For example, the gamma voltage generation circuit 1141 may have two output terminals, i.e., V1 and V2 shown in FIG. 3. V1 is connected to the highest gamma reference voltage output terminal Vg1 in the plurality of gamma reference voltage output terminals, and V2 is connected to the lowest gamma reference voltage output terminal Vgn in the plurality of gamma reference voltage output terminals.

Figure 4:
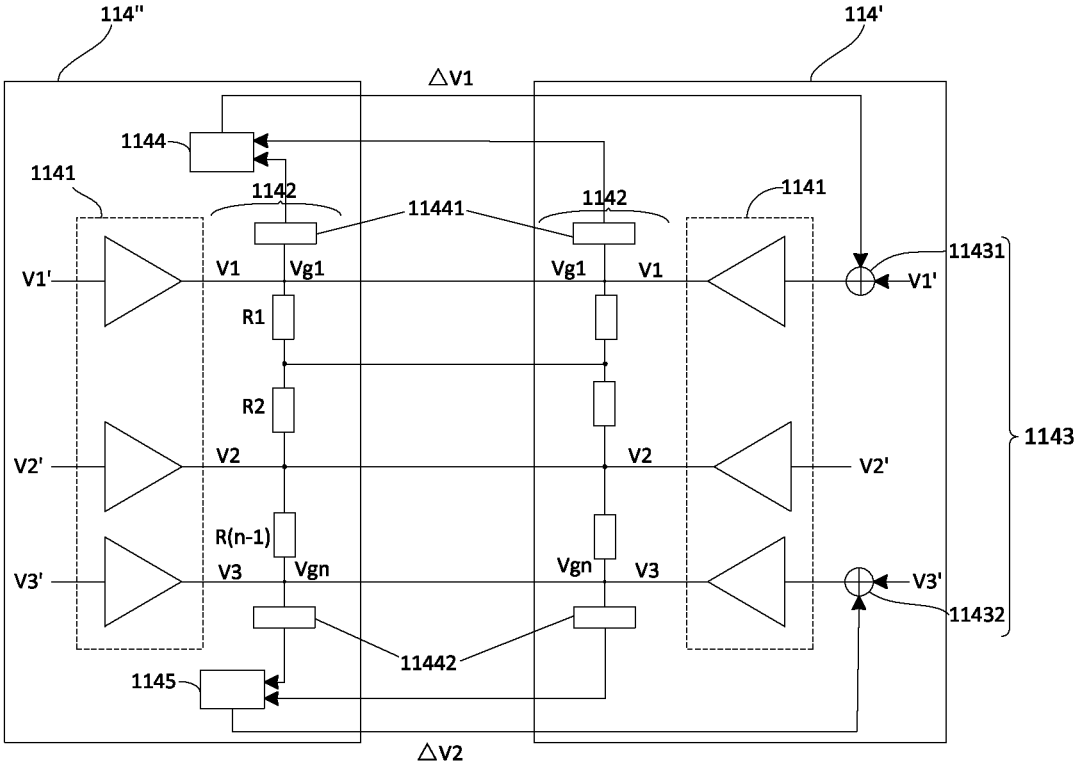
FIG. 4 is another structural diagram of a gamma voltage generating circuit, in accordance with some embodiments.

For example, the gamma voltage generation circuit 1141 may have three output terminals, i.e., V1, V2 and V3 shown in FIG. 4. V1 is connected to the highest gamma reference voltage output terminal Vg1 in the plurality of gamma reference voltage output terminals, V3 is connected to the lowest gamma reference voltage output terminal Vgn in the plurality of gamma reference voltage output terminals, and V2 is connected to any other gamma reference voltage output terminal except the highest gamma reference voltage output terminal Vg1 and the lowest gamma reference voltage output terminal Vgn.

Each of the N resistive voltage divider circuits 1142 includes a plurality of resistors (R1, R2, . . . , R (n−1) shown in FIG. 3) connected in series. Any two resistive voltage divider circuits 1142 have a same resistance ratio (i.e., R1:R2:R3: . . . :R (n−1)) of the plurality of resistors (R1, R2, . . . , R (n−1) shown in FIG. 3) connected in series. In each gamma voltage generating sub-circuit 114, a resistor is connected between every two adjacent gamma reference voltage output terminals. For example, as shown in FIG. 3, R1 is connected between Vg1 and Vg2, and R (n−1) is connected between Vg(n−1) and Vgn.

Any two resistive voltage divider circuits 1142 have a same resistance ratio of the plurality of resistors connected in series. In this way, in a case where a voltage between the highest gamma reference voltage output terminal Vg1 and the lowest gamma reference voltage output terminal Vgn in each gamma voltage generating sub-circuit 114 is the same, it is possible to make voltages distributed to the gamma reference voltage output terminals at a same gray scale are the same.

With continued reference to FIG. 3, the second gamma voltage generating sub-circuit 114" further includes a voltage modification module 1143. The voltage modification module 1143 is configured to modify voltages at output terminals of the gamma voltage generation circuit 1141 of the second gamma voltage generating sub-circuit 114", according to a voltage difference between gamma reference voltage output terminals corresponding to a same gray scale of the first gamma voltage generating sub-circuit 114' and the second gamma voltage generating sub-circuit 114" in the N gamma voltage generating sub-circuit 114, so that the voltages at the gamma reference voltage output terminals (Vg1, Vg2, . . . , Vgn shown in FIG. 3) at the same gray scale among the N gamma voltage generating sub-circuits are the same.

For example, as shown in FIG. 3, the gamma voltage generating circuit includes two gamma voltage generating sub-circuits 114 which are indicated as a first one and a second one from left to right. The first gamma voltage generating sub-circuit 114' may be any one of the two gamma voltage generating sub-circuits. In an example where the first one is the first gamma voltage generating sub-circuit 114', and the second one is the second gamma voltage generating sub-circuit 114", voltages at the gamma reference voltage output terminals of the two gamma voltage generating sub-circuits 114 corresponding to a same gray scale (such as 10 gray scale) are collected, and the voltage corresponding to the gray scale of the first gamma voltage generating sub-circuit 114' is used as the reference voltage. The voltage difference between the voltages at the gamma reference voltage output terminals of the second gamma voltage generating sub-circuit 114" and the first gamma voltage generating sub-circuit 114' corresponding to the same gray scale is calculated. Then, the voltage at the output terminal of the gamma voltage generation circuit 1141 in the second gamma voltage generating sub-circuit is modified according to the voltage difference.

As shown in FIG. 3, in some examples, the gamma voltage generation circuit 1141 has two output terminals. In a case where the gamma voltage generating circuit includes three gamma voltage generating sub-circuits, if the first one serves as the first gamma voltage generating sub-circuit 114', the second and third ones serve as the second gamma voltage generating sub-circuits 114". In each gamma voltage generating sub-circuit 114, two output terminals of a gamma voltage generation circuit 1141 are electrically connected to a highest gamma reference voltage output terminal Vg1 and a lowest gamma reference voltage output terminal Vgn in a plurality of gamma reference voltage output terminals, respectively.

In the above structure, a voltage modification method is that, according to the voltage differences (the voltage differences are each obtained by calculating the difference between the voltages at the gamma reference voltage output terminals of a corresponding second gamma voltage generating sub-circuit 114" and the first gamma voltage generating sub-circuit 114' corresponding to the same gray scale as described above), the voltages at the output terminals of the gamma voltage generation circuits 1141 in both the second generating sub-circuit and the third generating sub-circuit are modified. That is, the voltage at the highest gamma reference voltage output terminal Vg1 and the voltage at the lowest gamma voltage output terminal Vgn of each of the second generating sub-circuit and the third generating sub-circuit are modified, so that the voltage between the highest gamma reference voltage output terminal Vg1 and the lowest gamma reference voltage output terminal Vgn is the same for the three gamma voltage generating sub-circuits. In addition, any two gamma voltage generating sub-circuits 114 have a same resistance ratio of the plurality of resistors connected in series. Therefore, the voltages distributed to the gamma reference voltage output terminals at the same gray scale are also the same. That is, gray scale voltages corresponding to a same gray scale are the same, thereby reducing a brightness difference caused by the voltage difference.

As shown in FIG. 4, in some other examples, the gamma voltage generation circuit 1141 has three output terminals. In this case, besides the highest gamma reference voltage output terminal Vg1 and the lowest gamma reference voltage output terminal Vgn in the plurality of gamma reference voltage output terminals, the gamma voltage generation circuit 1141 also provides voltages to another gamma reference voltage output terminal Vgi between the highest gamma reference voltage output terminal Vg1 and the lowest gamma reference voltage output terminal Vgn. In this case, by modifying the voltage at each output terminal of the gamma voltage generation circuit 1141, the three gamma voltage generating sub-circuits have a same voltage at their lowest gamma reference voltage output terminals Vgn, a same voltage at their highest gamma reference voltage output terminals Vg1, and a same voltage at their another gamma reference voltage output terminals Vgi. In this way, the voltages distributed to gamma reference voltage output terminals at the same gray scale are the same, thereby reducing the brightness difference caused by the voltage difference.

It will be noted that, in all the embodiments of the present disclosure, for the N gamma voltage generating sub-circuits 114, unless otherwise specified, there is little difference between a voltage difference between gamma reference voltage output terminals of any two gamma voltage generating sub-circuits 114 corresponding to a gray scale and a voltage difference between gamma reference voltage output terminals of the two gamma voltage generating sub-circuits 114 corresponding to another gray scale. That is, if in the N gamma voltage generating sub-circuits, a voltage difference between the highest gamma reference voltage output terminals Vg1 of a certain gamma voltage generating sub-circuit 114 and another second gamma voltage generating sub-circuit 114" is a 15 mV, a voltage difference is also proximate to 15 mV between each gamma reference voltage output terminal and a corresponding gamma reference voltage output terminal of the two gamma voltage generating sub-circuits 114 other than the highest gamma reference voltage output terminals Vg1. The two gamma voltage generating sub-circuits 114 are any two gamma voltage generating sub-circuits 114 of the N gamma voltage generating sub-circuits.

Based on this, in some embodiments, the voltage difference between the gamma reference voltage output terminals corresponding to the same gray scale may be a voltage difference obtained by collecting and comparing voltages of the N gamma voltage generating sub-circuits 114 corresponding to any one of 256 gray scales. Alternatively, the voltage difference between the gamma reference voltage output terminals corresponding to the same gray scale may also be a voltage difference obtained by collecting voltages of the N gamma voltage generating sub-circuits corresponding to multiple gray scales of the 256 gray scales, comparing voltages corresponding to the same gray scale, and averaging the voltage differences. Alternatively, the voltage difference between the gamma reference voltage output terminals corresponding to the same gray scale may also be a plurality of voltage differences obtained by collecting voltages of the N gamma voltage generating sub-circuits corresponding to multiple gray scales in the 256 gray scales, and comparing voltages corresponding to the same gray scale. Herein, the number of voltage differences corresponding to the same gray scale is not specifically limited.

In practical application, one or more voltage differences may be collected according to actual needs. According to the one or more collected voltage differences, the voltages at the gamma reference voltage output terminals are modified through a whole modification method or a separate modification method.

Based on the above structure, in some embodiments, referring to FIG. 3, the gamma voltage generating circuit further includes first comparator(s) 1144 and second comparator(s) 1145. The first comparator 1144 is electrically connected to the highest gamma reference voltage output terminal Vg1 of the first gamma voltage generating sub-circuit 114' and the highest gamma reference voltage output terminal Vg1 of a second gamma voltage generating sub-circuit 114". The second comparator 1145 is electrically connected to the lowest gamma reference voltage output terminal Vgn of the first gamma voltage generating sub-circuit 114' and the lowest gamma reference voltage output terminal Vgn of a second gamma voltage generating sub-circuit 114".

The highest gamma reference voltage output terminal Vg1 of the first gamma voltage generating sub-circuit 114' is electrically connected to a non-inverting input terminal of the first comparator 1144, and the highest gamma reference voltage output terminal Vg1 of the second gamma voltage generating sub-circuit 114" is electrically connected to an inverting input terminal of the first comparator 1144. The lowest gamma reference voltage output terminal Vgn of the first gamma voltage generating sub-circuit 114' is electrically connected to a non-inverting input terminal of the second comparator 1145, and the lowest gamma reference voltage output terminal Vgn of the second gamma voltage generating sub-circuit 114" is connected to an inverting input terminal of the second comparator 1145.

In some examples, as shown in FIGS. 3 and 4, the voltage modification module 1143 in the gamma voltage generating circuit includes a first adder 11431 and a second adder 11432. The first adder 11431 is electrically connected to an output terminal of the first comparator 1144, and is also electrically connected to an input terminal that is connected to the highest gamma reference voltage output terminal Vg1 of the second gamma voltage generating sub-circuit 114". That is, the first adder 11431 is electrically connected between the output terminal of the first comparator 1144 and the input terminal connected to the highest gamma reference voltage output terminal Vg1 of the second gamma voltage generating sub-circuit 114". The second adder 11432 is electrically connected to an output terminal of the second comparator 1145, and is also electrically connected to an input terminal that is connected to the lowest gamma reference voltage output terminal Vgn of the second gamma voltage generating sub-circuit 114". That is, the second adder 11432 is electrically connected between the output terminal of the second comparator 1145 and the input terminal connected to the lowest gamma reference voltage output terminal Vgn of the second gamma voltage generating sub-circuit 114".

In the above embodiments, a first comparator 1144 is provided between the highest gamma reference voltage output terminal Vg1 of the first gamma voltage generating sub-circuit 114' and a highest gamma reference voltage output terminal Vg1 of each second gamma voltage generating sub-circuit 114", and detects a voltage difference ΔV1 between the highest gamma reference voltage output terminal Vg1 of the first gamma voltage generating sub-circuit 114' and the highest gamma reference voltage output terminal Vg1 of the second gamma voltage generating sub-circuit 114". Moreover, a detection result is superimposed to an input terminal connected to a highest gamma reference voltage output terminal Vg1 of the second gamma voltage generating sub-circuit 114" by the first adder 11431, so that the voltage output from the highest gamma reference voltage output terminal Vg1 of the second gamma voltage generating sub-circuit 114" may be the same as the voltage output from the highest gamma reference voltage output terminal Vg1 of the first gamma voltage generating sub-circuit 114'.

A second comparator 1145 is provided between the lowest gamma reference voltage output terminal Vgn of the first gamma voltage generating sub-circuit 114' and a lowest gamma reference voltage output terminal Vgn of each second gamma voltage generating sub-circuit 114", and detects a voltage difference ΔV2 between the lowest gamma reference voltage output terminal Vgn of the first gamma voltage generating sub-circuit 114' and the lowest gamma reference voltage output terminal Vgn of the second gamma voltage generating sub-circuit 114". Moreover, a detection result is superimposed to the input terminal connected to the lowest gamma reference voltage output terminal Vgn of the second gamma voltage generating sub-circuit 114" by the second adder 11432, so that the voltage output from the lowest gamma reference voltage output terminal Vgn of the second gamma voltage generating sub-circuit 114" may be the same as the voltage output from the lowest gamma reference voltage output terminal Vgn of the first gamma voltage generating sub-circuit 114'.

In this way, for the gamma voltage generating sub-circuits 114 of the gamma voltage generating circuit, the voltage between the highest gamma reference voltage output terminal Vg1 and the lowest gamma reference voltage output terminal Vgn is the same, so that voltages at corresponding gamma reference voltage output terminals are the same, thereby reducing the brightness difference caused by the voltage difference.

In some examples, as shown in FIGS. 3 and 4, the gamma voltage generating circuit further includes first voltage collector(s) 11441 and second voltage collector(s) 11442. A first voltage collector 11441 is electrically connected between the first comparator 1144 and each highest gamma reference voltage output terminal Vg1. A second voltage collector 11442 is electrically connected between the second comparator 1145 and each lowest gamma reference voltage output terminal Vgn.

In this way, the first voltage collector 11441 and the second voltage collector 11442 may make voltages input to the first comparator 1144 and the second comparator more stable, respectively.

Optionally, the first comparator 1144 and the highest gamma reference voltage output terminal Vg1 of the second gamma voltage generating sub-circuit 114" are electrically connected through a serial peripheral interface (SPI). The second comparator 1145 and the lowest gamma reference voltage output terminal Vgn of the second gamma voltage generating sub-circuit 114" are electrically connected through a SPI. The SPI supports a duplexer operation, is easy to operate and has a high data transmission rate.

Figure 5:
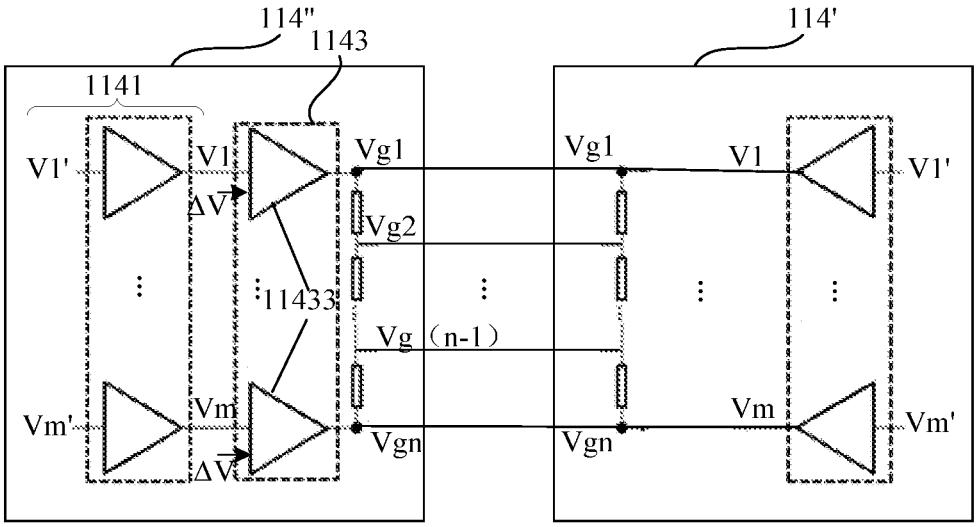
FIG. 5 is yet another structural diagram of a gamma voltage generating circuit, in accordance with some embodiments.

In some other embodiments, referring to FIG. 5, the voltage modification module 1143 includes operational amplifiers 11433. The operational amplifier 11433 is electrically connected between an output terminal of the gamma voltage generation circuit 1141 of the second gamma voltage generating sub-circuit 114" and the gamma reference voltage output terminal of the second gamma voltage generating sub-circuit 114". For example, as shown in FIG. 5, the operational amplifier 11433 is electrically connected between the output terminal of the gamma voltage generation circuit 1141 of the second gamma voltage generating sub-circuit 114" and the highest gamma reference voltage output terminal Vg1 of the second gamma voltage generating sub-circuit 114". A non-inverting input terminal of the operational amplifier 11433 is electrically connected to the output terminal of the gamma voltage generation circuit 1141, and an output terminal of the operational amplifier 11433 is connected to the gamma reference voltage output terminal. An inverting terminal of the operational amplifier 11433 is configured to receive a voltage difference ΔV between gamma reference voltage output terminals corresponding to the same gray scale of the first gamma voltage generating sub-circuit 114' and the second gamma voltage generating sub-circuit 114" where the operational amplifier 11433 is located.

In the above embodiments, the operational amplifier 11433 is provided between the output terminal of the gamma voltage generation circuit 1141 of the second gamma voltage generating sub-circuit 114" and the gamma reference voltage output terminal of the second gamma voltage generating sub-circuit 114", and may serve as an adder or a subtractor. According to the received voltage difference between the gamma reference voltage output terminals corresponding to the same gray scale of the first gamma voltage generating sub-circuit 114' and the second gamma voltage generating sub-circuit 114" where the operational amplifier 11433 is located, the voltage at the out terminal of the gamma voltage generation circuit 1141 is performed with an addition operation or a subtraction operation, and then a new gamma reference voltage is output, so that the voltages at corresponding gamma reference voltage output terminals of gamma voltage generating sub-circuits may be the same.

It will be noted that, if the collected voltage difference ΔV is the voltage difference that is the voltage of the first gamma voltage generating sub-circuit 114' minus the voltage (corresponding to the same gray scale as the voltage of the first gamma voltage generating sub-circuit 114') of the second gamma voltage generating sub-circuit 114" where the operational amplifier 11433 is located, the operational amplifier 11433 serves as the adder. If the collected voltage difference ΔV is the difference voltage that is the voltage (corresponding to the same gray scale as the voltage of the first gamma voltage generating sub-circuit 114') of the second gamma voltage generating sub-circuit 114" where the operational amplifier 11433 is located minus the voltage of the first gamma voltage generating sub-circuit 114', the operational amplifier 11433 serves as the subtractor.

In the gamma voltage generating circuit provided by some embodiments of the present disclosure, by collecting the voltages corresponding to the same gray scale in the plurality of gamma voltage generating sub-circuits 114, and taking the voltage of any one of the plurality gamma voltage generating sub-circuits 114 (i.e., the first gamma voltage generating sub-circuit 114') corresponding to the gray scale as a reference voltage, the voltage difference between the reference voltage and the voltage of each other gamma voltage generating sub-circuit 114 (i.e., the second gamma voltage generating sub-circuit 114") corresponding to the gray scale is calculated. According to the calculated voltage difference, the voltage at the output terminal of the gamma voltage generation circuit 1141 of each second gamma voltage generating sub-circuit 114" is modified, so that the voltage between the highest gamma reference voltage output terminal Vg1 and the lowest gamma reference voltage output terminal Vgn is the same for the gamma voltage generating sub-circuits 114, thereby reducing the brightness difference.

In some embodiments, as shown in FIGS. 3 and 5, the gamma reference voltage output terminals at the same gray scale in the N gamma voltage generating sub-circuits 114 are connected. The connection refers to connecting two points through a wire with a small effective resistance, so as to make voltages at the two points tend to balance.

In embodiments of the present disclosure, the gamma reference voltage output terminals at the same gray scale in the N gamma voltage generating sub-circuits 114 are connected, so that it is possible to further modify the voltages at the gamma reference voltage output terminals. As a result, the voltages at the gamma reference voltage output terminals at the same gray scale are the same, and a same gamma reference voltage may be provided to a pixel driver circuit.

Figure 6:
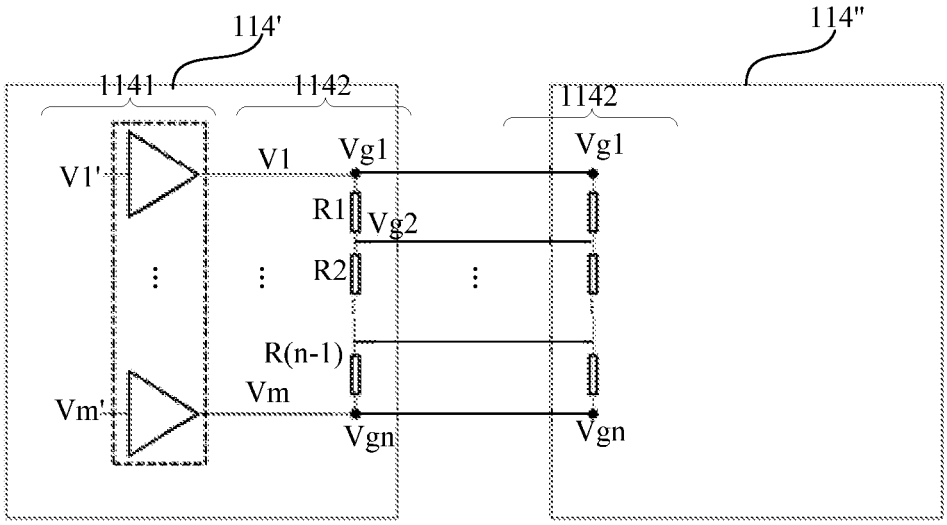
FIG. 6 is yet another structural diagram of a gamma voltage generating circuit, in accordance with some embodiments.

Some embodiments of the present disclosure provide a gamma voltage generating circuit. Referring to FIG. 6, the gamma voltage generating circuit includes N gamma voltage generating sub-circuits 114, and N is greater than or equal to 2.

Each of the N gamma voltage generating sub-circuits 114 includes a resistive voltage divider circuit 1142 and a plurality of gamma reference voltage output terminals (Vg1, Vg2, . . . , Vgn shown in FIG. 6). Each of the N resistive voltage divider circuits 1142 includes a plurality of resistors (R1, R2, . . . , R (n−1) shown in FIG. 6) connected in series. Any two resistive voltage divider circuits 1142 have a same resistance ratio (i.e., R1:R2:R3: . . . :R (n−1)) of the resistors (R1, R2, . . . , R (n−1) shown in FIG. 6) connected in series. In each gamma voltage generating sub-circuit 114, a resistor is connected between every two adjacent gamma reference voltage output terminals. For example, R1 is connected between Vg1 and Vg2, and R(n−1) is connected between Vg(n−1) and Vgn.

One of the N gamma voltage generating sub-circuits serves as a first gamma voltage generating sub-circuit (indicated by reference numeral 114'), and other gamma voltage generating sub-circuit(s) except the first gamma voltage generating sub-circuit serve as second gamma voltage generating sub-circuit(s) (indicated by reference numeral 114). In a case where it is not distinguished whether the gamma voltage generating sub-circuit is the first gamma voltage generating sub-circuit or the second gamma voltage generating sub-circuit, the gamma voltage generating sub-circuit is indicated by reference numeral 114.

With continued reference to FIG. 6, the first gamma voltage generating sub-circuit 114' in the N gamma voltage generating sub-circuits further includes a gamma voltage generation circuit 1141. Output terminals (V1 and Vm shown in FIG. 6) of the gamma voltage generation circuit 1141 are electrically connected to a highest gamma reference voltage output terminal Vg1 and a lowest gamma reference voltage output terminal Vgn in the plurality of gamma reference voltage output terminals (Vg1, Vg2, . . . , Vgn shown in FIG. 6), respectively.

The highest gamma reference voltage output terminals Vg1 of the gamma voltage generating sub-circuits 114 are connected, and the lowest gamma reference voltage output terminals Vgn of the gamma voltage generating sub-circuits 114 are connected. The connection refers to connecting two points through a wire with a small effective resistance, so as to make voltages at the two points tend to balance.

In this way, in the gamma voltage generating circuit provided by some embodiments of the present disclosure, the gamma voltage generation circuit 1141 of the first gamma voltage generating sub-circuit 114' provides voltages to the highest reference voltage output terminal Vg1 and the lowest reference voltage output terminal Vgn. The highest gamma reference voltage output terminals Vg1 of the gamma voltage generating sub-circuits 114 are connected, and the lowest gamma reference voltage output terminals Vgn of the gamma voltage generating sub-circuits 114 are connected. Thus, the voltage between the highest gamma reference voltage output terminal Vg1 and the lowest gamma reference voltage output terminal Vgn is the same for the gamma voltage generation sub-circuits 114, so that it is possible to provide a same reference voltage to the resistive voltage divider circuits 1142 of the N gamma voltage generating sub-circuits 114, thereby reducing the voltage difference caused by voltages provided by different gamma voltage generation circuits 1141, and reducing the brightness difference caused by the voltage difference.

Figure 7:
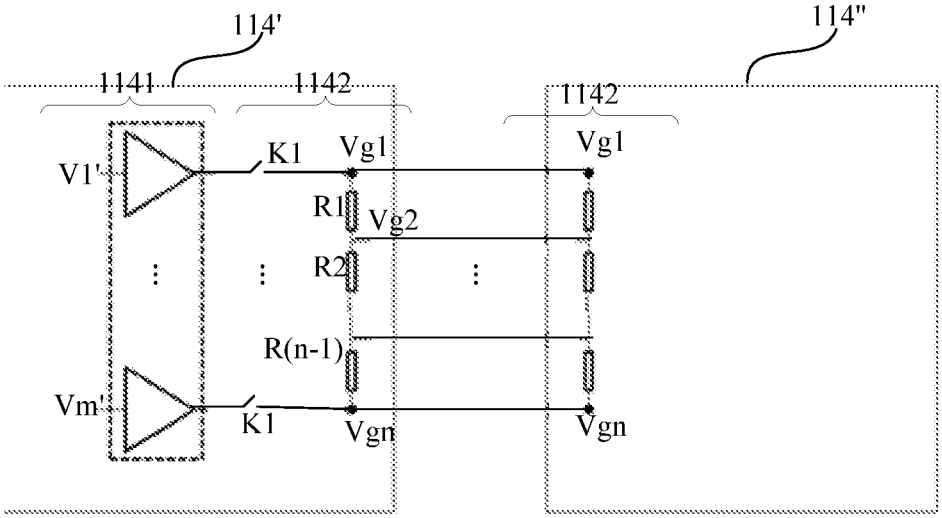
FIG. 7 is yet another structural diagram of a gamma voltage generating circuit, in accordance with some embodiments.

In some embodiments, as shown in FIG. 7, in the first gamma voltage generating sub-circuit 114', first control switches K1 are provided between an output terminal of the gamma voltage generation circuit 1141 and the highest gamma reference voltage output terminal Vg1, and between another output terminal of the gamma voltage generation circuit 1141 and the lowest reference voltage output terminal Vgn, respectively. The first control switches K1 are configured to connect or disconnect the output terminal of the gamma voltage generation circuit 1141 and the highest gamma reference voltage output terminal Vg1, and to connect or disconnect the output terminal of the gamma voltage generation circuit 1141 and the lowest gamma reference voltage output terminal Vgn.

Figure 8:
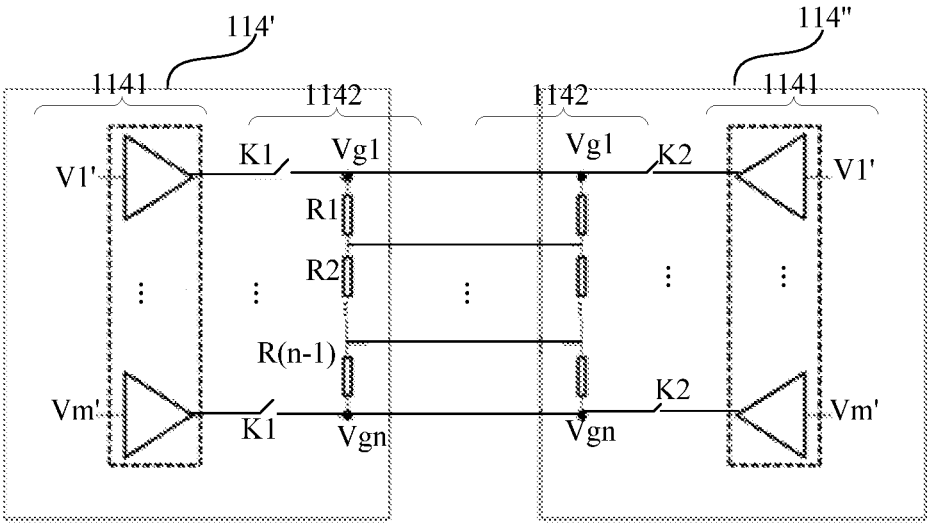
FIG. 8 is yet another structural diagram of a gamma voltage generating circuit, in accordance with some embodiments.

In some embodiments, as shown in FIG. 8, each second gamma voltage generating sub-circuit 114" in the N gamma voltage generating sub-circuits 114 includes a gamma voltage generation circuit 1141. In each second gamma voltage generating sub-circuit 114", the output terminals of the gamma voltage generation circuit 1141 are electrically connected to the highest gamma reference voltage output terminal Vg1 and the lowest gamma reference voltage output terminal Vgn in the plurality of gamma reference voltage output terminals, respectively.

In some examples, in each second gamma voltage generating sub-circuit 114", second control switches K2 are provided between an output terminal of the gamma voltage generation circuit 1141 and the highest gamma reference voltage output terminal Vg1, and between another output terminal of the gamma voltage generation circuit 1141 and the lowest gamma reference voltage output terminal Vgn, respectively. The second control switches K2 are configured to connect or disconnect the output terminal of the gamma voltage generation circuit 1141 and the highest gamma reference voltage output terminal Vg1 of the second gamma voltage generating sub-circuit 114", and to connect or disconnect the output terminal of the gamma voltage generation circuit 1141 and the lowest gamma reference voltage output terminal Vgn of the second gamma voltage generating sub-circuit 114".

In this way, the connection between the output terminals of the gamma voltage generation circuits 1141 and both the highest gamma reference voltage output terminals Vg1 and the lowest reference voltage output terminals Vgn of the gamma voltage generating sub-circuits 114 may be controlled by the first control switches K1 and the second control switches K2, and thus any one of the gamma voltage generation circuits 1141 may provide a same voltage to the highest gamma reference voltage output terminal Vg1 of each gamma voltage generating sub-circuit 114, and may provide a same voltage to the lowest reference voltage output terminal Vgn of each gamma voltage generating sub-circuit 114.

For example, if the first control switches K1 are turned on and the second control switches K2 are turned off, the first gamma voltage generating sub-circuit 114' provides a same voltage to the highest gamma reference voltage output terminal Vg1 of each gamma voltage generating sub-circuit 114, and provides a same voltage to the lowest gamma reference voltage output terminal Vgn of each gamma voltage generating sub-circuit 114.

For another example, if the second control switches K2 in any one of the second gamma voltage generating sub-circuits 114" are turned on, and the other second control switches K2 and the first control switches K1 are turned off, the highest gamma reference voltage output terminal Vg1 of each gamma voltage generating sub-circuit 114 may be provided with a same voltage, and the lowest reference voltage output terminal Vgn of each gamma voltage generating sub-circuit 114 may be provided with a same voltage.

For yet another example, in the first gamma voltage generating sub-circuit 114', the first control switch K1 connected between the gamma voltage generation circuit 1141 and the highest gamma reference voltage output terminal Vg1 is turned on, and the first control switch K1 connected between the gamma voltage generation circuit 1141 and the lowest gamma reference voltage output terminal Vgn is turned off. In addition, in any one of the second gamma voltage generating sub-circuits 114", the second control switch K2 connected between the gamma voltage generation circuit 1141 and the lowest gamma reference voltage output terminal Vgn is turned on, and all the other second control switches K2 are turned off. In this case, the highest gamma reference voltage output terminal Vg1 of each gamma voltage generating sub-circuit 114 may be provided with a same voltage, and the lowest reference voltage output terminal Vgn of each gamma voltage generating sub-circuit 114 may be provided with a same voltage.

It will be noted that, if a voltage difference between the highest gamma reference voltage output terminal Vg1 and the lowest reference voltage output terminal Vgn is the same for the N gamma voltage generating sub-circuits, the same reference voltage may be provided to each resistive voltage divider circuit 1142. However, in practical application, there is a difference between an actual resistance and a theoretical value of a resistor. Therefore, there is also a voltage difference for other gamma reference voltage output terminals except the highest gamma reference voltage output terminal Vg1 and the lowest reference voltage output terminal Vgn.

Based on this, as a possible implementation manner, as shown in FIGS. 6 to 8, besides the highest gamma reference voltage output terminals Vg1 and the lowest reference voltage output terminals Vgn, the other gamma reference voltage output terminals in the gamma reference voltage output terminals of the N gamma voltage generation sub-circuits 114 corresponding to the same gray scale are connected. The connection refers to connecting two points through a wire with a small effective resistance, so as to make voltages at the two points tend to balance. In this way, in the N gamma voltage generating sub-circuits 114, the voltage difference between corresponding gamma reference voltage output terminals tends to be consistent, and the same gamma reference voltage may be provided to the pixel driver circuit.

Figure 9:
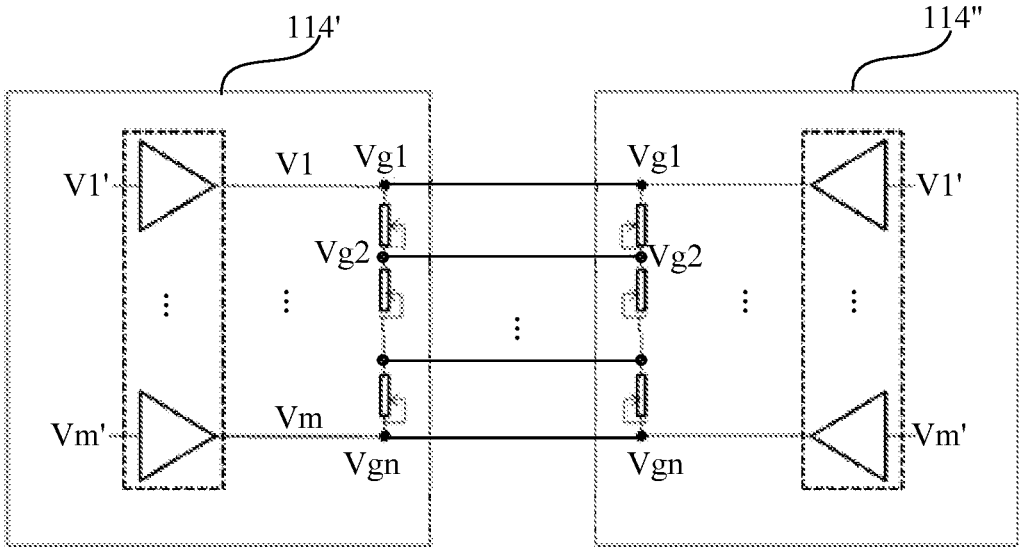
FIG. 9 is yet another structural diagram of a gamma voltage generating circuit, in accordance with some embodiments.

In some embodiments, referring to FIG. 9, each of the plurality of resistors is a variable resistor. The gamma voltage generating circuit further includes a control module electrically connected to the resistors. The control module is configured to regulate a resistance of each resistor, so that the N gamma voltage generating sub-circuits have a same resistance ratio of the plurality of resistors connected in series. Herein, the resistances of the plurality of resistors refer to actual resistances of the plurality of resistors.

Since there is a difference between the actual resistance and the theoretical value of the resistor, by using the variable resistors as the resistors and regulating the resistance values of the resistors through the control module, it is possible to make the actual resistance values of the resistors meet the demand, so that the voltages at the gamma reference voltage output terminals are the same, and the same gamma reference voltage may be provided to the pixel driver circuit.

Some embodiments of the present disclosure further provide a driver circuit, and the driver circuit includes the gamma voltage generating circuit described above and a plurality of data driver circuits. Each of the plurality of data driver circuits is electrically connected to one gamma voltage generating sub-circuit of the gamma voltage generating circuit. For example, the number of the plurality of data driver circuits corresponds to the number of the gamma voltage generating sub-circuits, and each data driver circuit is connected to a corresponding gamma voltage generating sub-circuit. The gamma voltage generating sub-circuit is configured to provide gamma reference voltages to the data driver circuit.

The driver circuit may provide a same gray scale voltage to different pixel units of a display panel, thereby reducing the brightness difference of the display panel.

The driver circuit may provide driving signals to any product or component having a display function, such as a liquid crystal display panel, an electronic paper, an OLED panel, a mobile phone, a tablet computer, a television, a display, a notebook computer, a digital photo frame, or a navigating instrument.

Some embodiments of the present disclosure further provide a display device including the driver circuit described above. The display device may reduce the brightness difference of the display panel.

The display device may be any product or component having a display function, such as a liquid crystal display panel, an electronic paper, an OLED panel, a mobile phone, a tablet computer, a television, a display, a notebook computer, a digital photo frame, or a navigating instrument.

Figure 10:
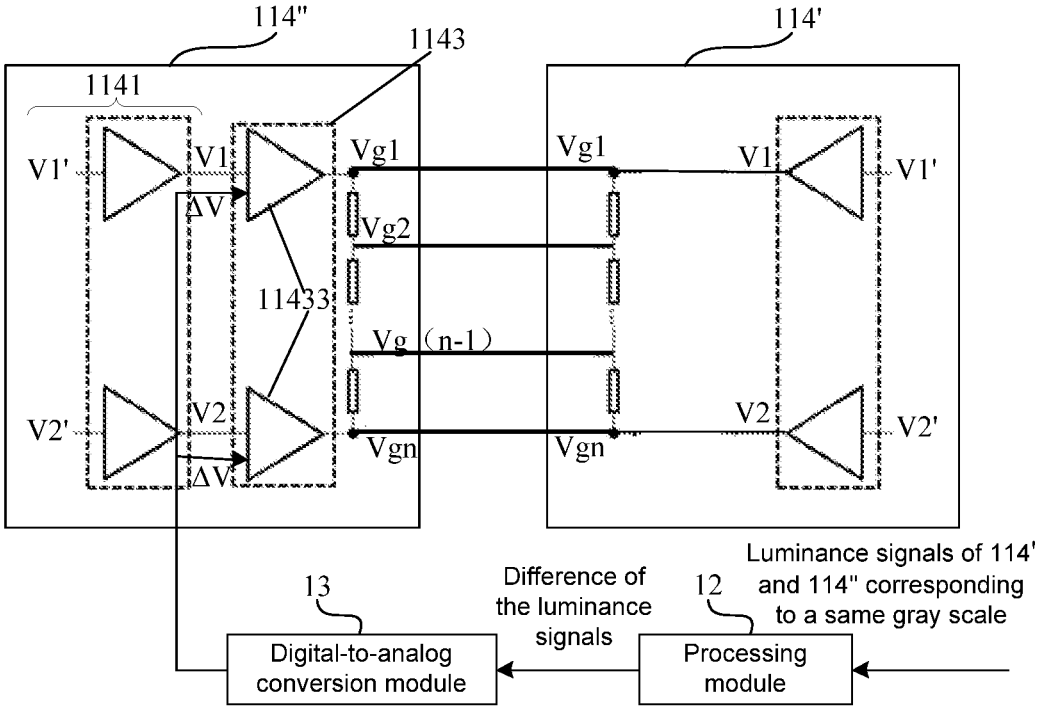
FIG. 10 is a structural diagram of a display device, in accordance with some embodiments.

In an optional embodiment of the present disclosure, in a case where the voltage modification module 1143 in the gamma voltage generating circuit includes operational amplifiers 11433 each connected between an output terminal of the gamma voltage generation circuit 1141 and the gamma reference voltage output terminal in each second gamma voltage generating sub-circuit 114", referring to FIG. 10, the display device further includes a processing module 12 and a digital-to-analog conversion module 13. The digital-to-analog conversion module 13 is electrically connected to the processing module 12, and the digital-to-analog conversion module 13 is electrically connected to each operational amplifier 11433. The processing module 12 is configured to compare luminance signals corresponding to a same gray scale of the first gamma voltage generating sub-circuit 114' and each second gamma voltage generating sub-circuit 114" of the N gamma voltage generating sub-circuits, so as to obtain differences of the luminance signals. The digital-to-analog conversion module 13 is configured to convert the obtained differences of the luminance signals into voltage differences, and to feed back the obtained voltage differences to corresponding operational amplifiers 11433.

The luminance signals corresponding to the same gray scale of the first gamma voltage generating sub-circuit 114' and each second gamma voltage generating sub-circuit 114" may be obtained through a method of optical photography.

For example, the digital-to-analog conversion module 13 converts the obtained difference of luminance signals into a voltage difference, and the conversion may be performed according to a current formula used to convert the luminance signal into the voltage signal.

The forgoing descriptions are merely specific implementation manners of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. A gamma voltage generating circuit, comprising N gamma voltage generating sub-circuits, wherein N is greater than or equal to 2;

each gamma voltage generating sub-circuit includes:

a plurality of gamma reference voltage output terminals;

a gamma voltage generation circuit, output terminals of the gamma voltage generation circuit being electrically connected to a highest gamma reference voltage output terminal and a lowest gamma reference voltage output terminal in the plurality of gamma reference voltage output terminals, respectively; and a resistive voltage divider circuit, including a plurality of resistors connected in series, one of the plurality of resistors being connected between every two adjacent gamma reference voltage output terminals, wherein any two of the N resistive voltage divider circuits have a same resistance ratio of the plurality of resistors connected in series;

the N gamma voltage generating sub-circuits include:

a first gamma voltage generating sub-circuit; and at least one second gamma voltage generating sub-circuit, wherein each second gamma voltage generating sub-circuit further includes a voltage modification module configured to modify voltages at output terminals of a gamma voltage generation circuit of the second gamma voltage generating sub-circuit, according to a voltage difference between gamma reference voltage output terminals corresponding to a same gray scale of the first gamma voltage generating sub-circuit and the second gamma voltage generating sub-circuit, so as to make voltages at gamma reference voltage output terminals of the N gamma voltage generating sub-circuits at the same gray scale are the same.

2. The gamma voltage generating circuit according to claim 1, wherein each second gamma voltage generating sub-circuit further includes:

a first comparator, a non-inverting input terminal of the first comparator being electrically connected to a highest gamma reference voltage output terminal of the first gamma voltage generating sub-circuit, an inverting input terminal of the first comparator being electrically connected to a highest gamma reference voltage output terminal of the second gamma voltage generating sub-circuit; and a second comparator, a non-inverting input terminal of the second comparator being electrically connected to a lowest gamma reference voltage output terminal of the first gamma voltage generating sub-circuit, an inverting input terminal of the second comparator being electrically connected to a lowest gamma reference voltage output terminal of the second gamma voltage generating sub-circuit.

3. The gamma voltage generating circuit according to claim 2, wherein each second gamma voltage generating sub-circuit further includes:

a first voltage collector electrically connected between the first comparator and the highest gamma reference voltage output terminal of the second gamma voltage generating sub-circuit; and, a second voltage collector electrically connected between the second comparator and the lowest gamma reference voltage output terminal of the second gamma voltage generating sub-circuit.

4. The gamma voltage generating circuit according to claim 2, wherein the voltage modification module includes:

a first adder electrically connected to an output terminal of the first comparator and an input terminal connected to the highest gamma reference voltage output terminal of the second gamma voltage generating sub-circuit; and a second adder electrically connected to an output terminal of the second comparator and an input terminal connected to the lowest gamma reference voltage output terminal of the second gamma voltage generating sub-circuit.

5. A driver circuit, comprising:

the gamma voltage generating circuit according to claim 1; and a plurality of data driver circuits, wherein each of the plurality of data driver circuits is electrically connected to one gamma voltage generating sub-circuit of the gamma voltage generating circuit; and the gamma voltage generating sub-circuit is configured to provide gamma reference voltages to the data driver circuit.

6. A display device, comprising the driver circuit according to claim 5.

7. The gamma voltage generating circuit according to claim 1, wherein the voltage modification module includes operational amplifiers; and a non-inverting input terminal of each operational amplifier is electrically connected to an output terminal of a corresponding gamma voltage generation circuit of the second gamma voltage generating sub-circuit, and an output terminal of the operational amplifier is electrically connected to a corresponding gamma reference voltage output terminal of the second gamma voltage generating sub-circuit, and an inverting terminal of the operational amplifier is configured to receive a voltage difference between gamma reference voltage output terminals corresponding to a same gray scale of the first gamma voltage generating sub-circuit and the second gamma voltage generating sub-circuit where the operational amplifier is located.

8. The gamma voltage generating circuit according to claim 1, wherein in the N gamma voltage generating sub-circuits, gamma reference voltage output terminals corresponding to a same gray scale are connected.

9. A gamma voltage generating circuit, comprising N gamma voltage generating sub-circuits, wherein N is greater than or equal to 2;

each gamma voltage generating sub-circuit includes:

a plurality of gamma reference voltage output terminals; and a resistive voltage divider circuit, including a plurality of resistors connected in series, one of the plurality of resistors being connected between every two adjacent gamma reference voltage output terminals, wherein any two of N resistive voltage divider circuits have a same resistance ratio of the plurality of resistors connected in series, the N gamma voltage generating sub-circuits include a first gamma voltage generating sub-circuit, and the first gamma voltage generating sub-circuit further includes:

a gamma voltage generation circuit, output terminals of the gamma voltage generation circuit being electrically connected to a highest gamma reference voltage output terminal and a lowest gamma reference voltage output terminal in the plurality of gamma reference voltage output terminals of the first gamma voltage generating sub-circuit, respectively; and first control switches, the first control switches being respectively disposed between an output terminal of the gamma voltage generation circuit and the highest gamma reference voltage output terminal, and between another output terminal of the gamma voltage generation circuit and the lowest gamma reference voltage output terminal, and the first control switches being configured to connect or disconnect the output terminal of the gamma voltage generation circuit and the highest gamma reference voltage output terminal, and to connect or disconnect the another output terminal of the gamma voltage generation circuit and the lowest gamma reference voltage output terminal, wherein highest gamma reference voltage output terminals of the N gamma voltage generating sub-circuits are connected, and lowest gamma reference voltage output terminals of the N gamma voltage generating sub-circuits are connected.

10. The gamma voltage generating circuit according to claim 9, wherein the N gamma voltage generating sub-circuits further include at least one second gamma voltage generating sub-circuit;

each second gamma voltage generating sub-circuit includes a gamma voltage generation circuit; and output terminals of the gamma voltage generation circuit in the second gamma voltage generating sub-circuit are electrically connected to a highest gamma reference voltage output terminal and a lowest gamma reference voltage output terminal in a plurality of gamma reference voltage output terminals of the second gamma voltage generating sub-circuit, respectively.

11. The gamma voltage generating circuit according to claim 10, wherein the second gamma voltage generating sub-circuit further includes second control switches provided between an output terminal of the gamma voltage generation circuit and the highest gamma reference voltage output terminal of the second gamma voltage generating sub-circuit, and between another output terminal of the gamma voltage generation circuit and the lowest gamma reference voltage output terminal of the second gamma voltage generating sub-circuit, respectively; and the second control switches are configured to connect or disconnect the output terminal of the gamma voltage generation circuit and the highest gamma reference voltage output terminal of the second gamma voltage generating sub-circuit, and to connect or disconnect the another output terminal of the gamma voltage generation circuit and the lowest gamma reference voltage output terminal of the second gamma voltage generating sub-circuit.

12. A driver circuit, comprising:

the gamma voltage generating circuit according to claim 9; and a plurality of data driver circuits, wherein each of the plurality of data driver circuits is electrically connected to one gamma voltage generating sub-circuit of the gamma voltage generating circuit; and the gamma voltage generating sub-circuit is configured to provide gamma reference voltages to the data driver circuit.

13. A display device, comprising the driver circuit according to claim 12.

14. The gamma voltage generating circuit according to claim 9, wherein in the N gamma voltage generating sub-circuits, gamma reference voltage output terminals corresponding to a same gray scale in gamma reference voltage output terminals other than the highest gamma reference voltage output terminals and the lowest gamma reference voltage output terminals are connected.

15. The gamma voltage generating circuit according to claim 9, wherein each of the plurality of resistors is a variable resistor.

* * * * *